US005941081A

United States Patent [19]

Burgener

[11] Patent Number: 5,941,081

[45] Date of Patent: Aug. 24, 1999

[54] SOLID PHASE LATENT HEAT VAPOR EXTRACTION AND RECOVERY SYSTEM FOR LIQUIFIED GASES

[75] Inventor: David Burgener, Elmhurst, Ill.

[73] Assignee: Air Liquide America Corp., Houston, Tex.

[21] Appl. No.: 08/958,186

[22] Filed: Oct. 27, 1997

[51] Int. Cl.[6] ..... F17C 7/02

[52] U.S. Cl. ..... 62/50.1; 62/54.2

[58] Field of Search ..... 62/50.1, 54.2

[56] References Cited

U.S. PATENT DOCUMENTS

| | | | |
|---|---|---|---|
| 2,487,863 | 11/1949 | Garretson | 62/50.1 |
| 3,106,071 | 10/1963 | Green et al. | 62/50.1 |
| 3,149,474 | 9/1964 | Goodman . | |
| 3,680,327 | 8/1972 | Stein . | |
| 3,798,918 | 3/1974 | Maher et al. | 62/637 |
| 4,211,085 | 7/1980 | Tyree, Jr. . | |
| 4,693,737 | 9/1987 | Tyree, Jr. . | |
| 4,964,278 | 10/1990 | Wen et al. . | |
| 5,209,078 | 5/1993 | Conrad et al. . | |
| 5,333,461 | 8/1994 | Cobb . | |
| 5,507,150 | 4/1996 | Weber et al. . | |

*Primary Examiner*—Ronald Capossela
*Attorney, Agent, or Firm*—Burns, Doane, Swecker & Mathis, L.L.P.

[57] ABSTRACT

The invention provides a system for unloading liquified gases from rail cars or other transport vehicles by using an energy buffer system which allows the shifting of electric demand to off-peak hours when electric power rates are lower. The system employs a buffer tank containing solidified gas to withdraw vapor remaining in the rail car after the liquified gas has been removed. The invention relies on the fact that the liquified gas which is to be unloaded has a triple point pressure that is low enough to allow recovery of the majority of the residual vapor in the rail car. The system allows the use of a smaller refrigeration unit operating at a constant load over a long period of time, in place of a larger refrigeration unit. The system also provides an additional advantage of extracting vapor from a rail car at a faster rate than the rate which is possible with a typical compressor.

17 Claims, 3 Drawing Sheets

SOLID PHASE LATENT HEAT VAPOR EXTRACTION AND RECOVERY SYSTEM FOR LIQUIFIED GASES

BACKGROUND OF THE INVENTION

1. Field of the Invention

The invention relates to a process for unloading transport vehicles containing a liquified gas. More particularly, the invention relates to a process that uses the latent heat conversion energy characteristics of certain gases such as carbon dioxide or nitrous oxide in their solid state to unload and store vapor remaining in rail cars or trucks after a liquified gas has been unloaded.

2. Brief Description of the Related Art

Liquified gases such as liquid carbon dioxide and liquid nitrous oxide are shipped to customers or depots as refrigerated liquids in insulated railroad tank cars. The shipping temperatures for liquid carbon dioxide range, for example, from 150 psig, −34° F. (10.34 bars, −36.7° C.) to 350 psig, +11° F. (24.13 bars, −11.7° C.). The railroad cars used for shipping liquified gases typically do not have refrigeration, thus, the liquified carbon dioxide or other liquid increases in pressure during transit due to normal warming of the liquid via heat transfer through the insulation of the rail car. A typical shipment by rail takes 5–20 days depending on both the distance traveled and the number of rail transfers required. Ambient heat entering the insulated rail car during transit gradually warms the liquified carbon dioxide increasing the pressure inside the rail car. A relief valve is provided on the rail car and set to operate at about 350 psig (24.13 bars) to vent a small amount of vapor carbon dioxide to the atmosphere to self refrigerate and maintain the pressure within the car at 350 psig (24.13 bars).

Although all attempts are made to reduce or eliminate venting losses during transit due to warming of the liquid, the internal pressure on a rail car arriving at an unloading location is often as high as 350 psig (24.13 bars). At the unloading location, the liquid carbon dioxide is removed from the rail car and transferred to a delivery tanker, storage tank, or depot tank. Most depot tanks maintain storage pressures of between 200 psig, −20° F. (13.79 bars, −28.9° C.) and 300 psig, 2° F. (20.68 bars, −16.7° C.). The depot tank pressure is controlled by a mechanical refrigeration system that cools and condenses carbon dioxide vapor to achieve the desired depot tank pressure. Rail cars may also be unloaded directly into delivery tankers for delivery to a final destination. Most carbon dioxide delivery tankers have design pressures of between 250 psig (17.24 bars) and 300 psig (20.68 bars). Thus, it is not possible to pump "warm" high pressure carbon dioxide directly from the rail car at 350 psig (24.13 bars) into the delivery tankers, storage tanks, or depot tanks without first decreasing the rail car pressure.

The rail car pressure can be decreased either 1) by venting vapor to the atmosphere; 2) by using mechanical refrigeration to cool liquid and condense vapor removed from the rail car; or 3) by mixing cool carbon dioxide liquid in a depot tank with the warm liquid and/or vapor carbon dioxide from the rail car to equalize the liquid carbon dioxide at an acceptable pressure. Generally, venting of the carbon dioxide vapor to the atmosphere to reduce the rail car pressure is undesirable since venting losses decrease efficiency. Therefore, refrigeration or a combination of refrigeration and mixing with cold liquid are generally used to decrease the rail car pressure to an acceptable level.

A typical rail car contains approximately 80–90 tons (72,570–81,645 kg) of liquid carbon dioxide. Once the liquid carbon dioxide is unloaded from the rail car, there is approximately three to four tons (2720–3630 kg) of carbon dioxide vapor left in the car at about 300 psig (20.68 bars) to 350 psig (24.13 bars). Typically, a compressor is used to remove some of this high pressure carbon dioxide vapor from the rail car and increase the pressure of the vapor sufficiently to force it into the depot tank. A refrigeration system associated with the depot tank, then condenses the vapor to a liquid to maintain the normal tank pressure of 200 psig (13.79 bars) to 300 psig (20.68 bars). However, this process requires that the refrigeration unit of the depot tank have sufficient capacity to condense the vapor at the same rate as it is extracted from the rail car. The refrigeration unit must be large enough to handle ordinary heat leak through the depot tank insulation, the entire heat load of the warm liquid carbon dioxide from the rail car, and the heat of condensation for the vapor which has been extracted from the rail car.

The process of unloading an approximately 80 ton (72,570 kg) rail car typically takes between 4 and 8 hours, and the amount of heat that must be removed from the storage tank to maintain the required storage tank pressure and prevent vapor from being vented is approximately $2\times10^6$ Btu/rail car. This is equal to approximately 21 tons ($15.2\times10^5$ Cal) of refrigeration spread over 8 hours. In contrast, the refrigeration which is required to maintain the depot tank pressure and compensate for normal heat leak through the depot tank insulation is typically less than 5 tons ($3.6\times10^5$ Cal) for the same 8 hour period.

Another method for reducing the temperature and thus, the pressure of the liquid carbon dioxide in the depot tank is to maintain a cool supply of liquid carbon dioxide within the depot tank and deliver the warm carbon dioxide liquid from the rail car to the depot tank mixing the hot 350 psig, 11° F. (24.13 bars, −11.7° C.) rail car liquid with cool 200 psig, −20° F. (13.79 bars, −28.9° C.) stored liquid to chill the hot rail car liquid. Typically, depot storage tanks have a minimum design metal temperatures (MDMT) of −20° F. (−28.9° C.) which is the lowest liquid temperature which can be safely used with the depot tank without the metal becoming brittle. This means that the lowest temperature allowed for the cool carbon dioxide liquid maintained in the depot tank to be mixed with the hot rail car liquid would be 200 psig, −20° F. (13.79 bars, 28.9° C.). Therefore, if cold depot liquid is going to be mixed with a warm rail car liquid to reduce the required refrigeration load at the time of unloading the rail car, then 200 psig, −20° F. (13.79 bars, −28.9° C.) is effectively the practical and economic low temperature limit for the cold depot liquid. Accordingly, the process of cooling hot rail car liquid with a supply of cold liquid in the depot tank works only when there is an adequate volume of cold liquid to equilibrate at an acceptable temperature level. If the mass of cold liquid in the depot tank is low, then there is little energy that can be "borrowed" from the cold liquid to chill and equilibrate with the hot rail car liquid unloaded from the rail car.

A problem that users and manufacturers of carbon dioxide and other related liquified gases face is to be able to install refrigeration units on the depot tanks which are large enough to recover all of the liquid carbon dioxide and most of the vapor carbon dioxide without requiring venting to the atmosphere or returning the car partially filled with carbon dioxide vapor. The refrigeration unit which is required to handle the entire heat load of an approximately 80 ton (72,570 kg) rail car must be able to cool $2\times10^6$ Btu/rail car during the 4 to 8 hour unloading time period. In addition, United States Department of Transportation regulations require that rail cars be attended at all times during unloading. Therefore, in order to reduce the cost of labor, it is economically desirable to unload rail cars as rapidly as possible. This means that the refrigeration unit needs to be of a sufficient size to handle the large instantaneous cooling load. Otherwise, not all of the available vapor can be recovered before the rail car is returned to be refilled. The large and expensive refrigeration unit required to achieve the desired unloading time of between 4 and 8 hours is generally underutilized during a substantial portion of time when rail cars are not being unloaded. Further, most rail car unloading is performed during daylight hours which correspond with on-peak electric power rates.

Accordingly, it would be desirable to provide a system for unloading rail cars at the same or a faster rate than is currently possible, while using a smaller refrigeration unit. It would also be desirable to be able to operate the refrigeration unit during off-peak hours when electric power rates are lower and to still be able to unload the rail car during daylight hours.

SUMMARY OF THE INVENTION

The present invention addresses the problems with the prior art by providing a system for unloading liquified gases from rail cars by using an energy "buffer" system which allows shifting electric demand to off-peak hours when electric power rates are lower while unloading during daylight hours.

One aspect of the present invention involves a method of unloading a transport vehicle containing a liquified gas and recovering vapor remaining in the transport vehicle after the liquified gas has been removed. The method includes the steps of unloading the liquified gas from the transport vehicle into a liquified gas storage tank, and unloading the vapor remaining in the transport vehicle after the liquified gas has been unloaded by delivering the vapor via a pressure gradient into a buffer tank partially filled with solidified gas. Vapor from the buffer tank is then later transferred to the liquified gas storage tank to convert liquified gas in the buffer tank to solid phase. The liquified gas and vapor in the storage tank are cooled to maintain a desired storage tank pressure.

According to a more detailed aspect of the invention, the unloaded vapor is delivered into a bottom of the buffer tank and passes up around the solidified gas within the buffer tank, improving mixing, and causing the solidified gas to convert to liquified gas at a constant pressure.

In accordance with another more detailed aspect of the present invention, the pressure in the transport vehicle is reduced to a pressure adequate for transferring to the storage tank by extracting vapor from the transport vehicle into the buffer tank before unloading the liquified gas from the transport vehicle.

In accordance with an additional aspect of the invention, a system for unloading liquified gas from a rail car includes a storage tank for storing the liquified gas which has been unloaded from the rail car, a buffer tank for receiving and storing residual vapor remaining in the rail car after the liquified gas has been unloaded, contacting the vapor with solidified gas to cool and condense the vapor and means for transferring condensed low pressure vapor from the buffer tank to the higher pressure storage tank and shifting an electric demand required to condense the vapor to lower cost off-peak energy rates. The buffer tank contains a supply of solidified gas for cooling the vapor.

According to a further aspect of the present invention, a method is described for shifting refrigeration electric power demand, in a rail car unloading system for unloading liquified gas from the rail car, to off-peak energy rates by using a buffer system which takes advantage of the latent heat conversion energy characteristics of the liquified gas.

The present invention provides an advantage of allowing the use of a smaller refrigeration unit operating at a constant load over a 24 hour period in place of a larger refrigeration unit for cooling primarily during unloading.

The present invention also provides an advantage of shifting electrical power demand to less expensive off-peak electrical power rates.

Further, the invention provides an additional advantage of extracting vapor from the rail car at a faster rate than that which is possible with a typical compressor used for rail car unloading. The latent heat buffer tank system flow rate of the extracted vapor is limited only by the pipe size.

BRIEF DESCRIPTION OF THE DRAWINGS

The invention will now be described in greater detail with reference to preferred embodiments illustrated in the accompanying drawings in which like elements bear like reference numerals, and wherein.

DETAILED DESCRIPTION OF THE PREFERRED EMBODIMENTS

Figure 1:
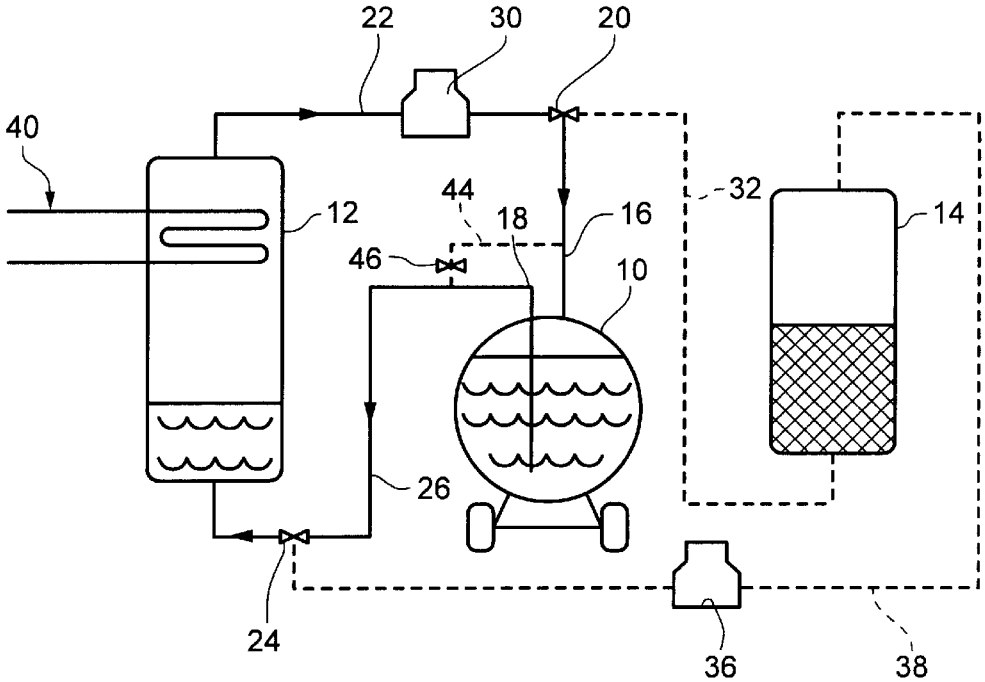
FIG. 1 is a schematic side view of a system for unloading liquified gas from a rail car illustrating a first step of unloading the liquified gas.
Figure 2:
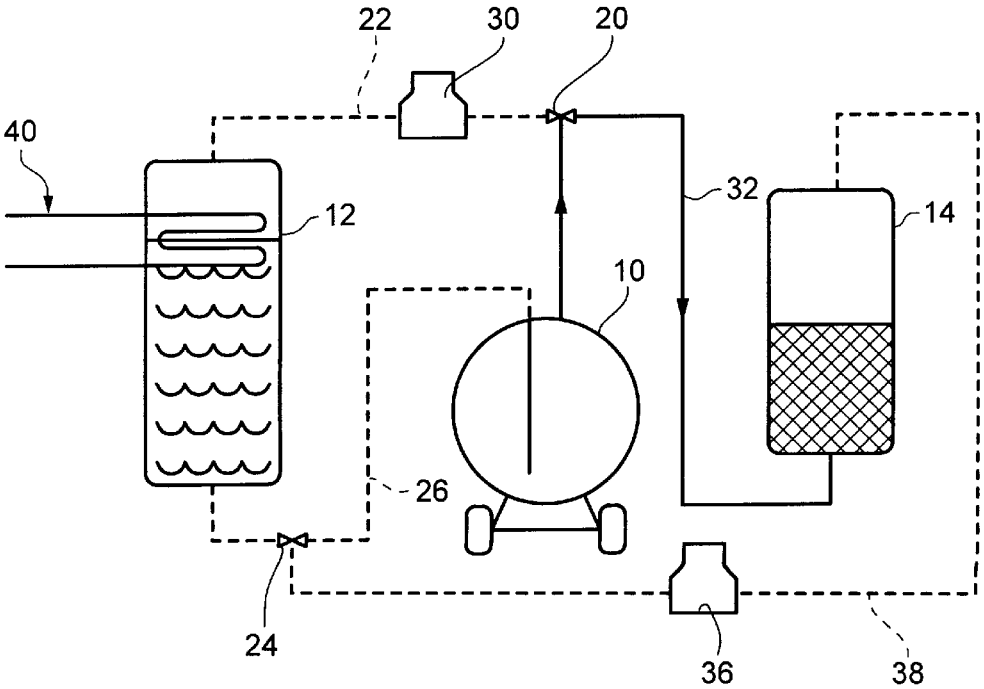
FIG. 2 is a schematic side view of the system of FIG. 1 in which a second step of unloading vapor from the rail car into a buffer tank is illustrated.
Figure 3:
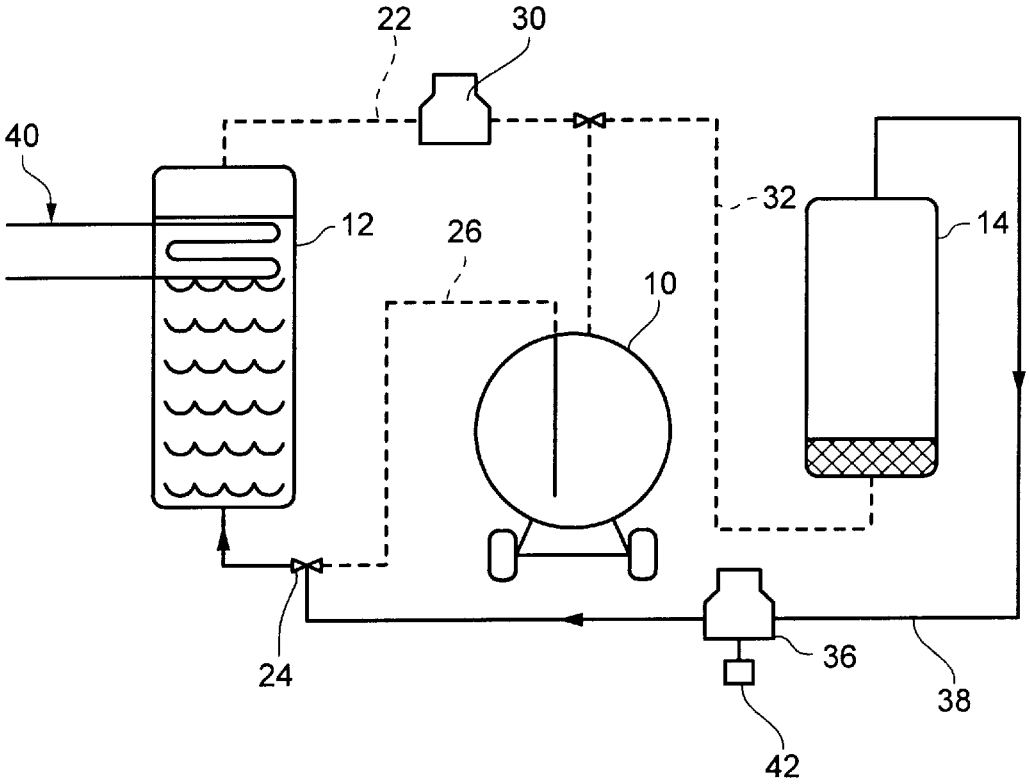
FIG. 3 is a schematic side view of the system of FIG. 1 in which a third step of removing vapor from the buffer tank to self-refrigerate the liquified gas in the buffer tank is illustrated.

A system and method for unloading liquified gas from a rail car or other transport vehicle is shown in FIGS. 1–3. The system includes a transport vehicle 10, a storage tank 12, and a buffer tank 14. The system is used to unload liquified gases such as carbon dioxide, nitrous oxide, and others from the transport vehicle 10, to the storage tank 12 and employs the buffer tank 14 to delay the cooling load of the unloading process. The system depends on the fact that the liquified gas which is to be unloaded has a triple point pressure low enough to allow the majority of the residual rail car vapor to be absorbed by the solidified gas without exceeding the triple point pressure.

The invention takes advantage of the latent heat of vaporization of the liquified gas at its triple point. By withdrawing vapor from the buffer tank 14 containing liquified gas, the liquified gas self refrigerates and solidifies, turning to "dry ice" or carbon dioxide snow. The solidified gas can then be used as a high density "energy storage battery" to cool and condense residual vapor which is later withdrawn from the transport vehicle 10. The advantages of the present invention are provided by the buffer tank 14, which is a latent heat buffer tank and preferably is a small, well insulated, vacuum vessel of a type used for cryogenic liquids with an MDMT at least as low as −70° F. (−56.7° C.).

The present invention will be described in the following discussion as a system for unloading liquid carbon dioxide from a rail car which has been used to transport the liquid.

However, it should be understood that the invention is also intended to be used for other liquified gases, and for unloading vehicles and containers other than rail cars. In addition, although the present invention has been described as employing "dry ice" or carbon dioxide snow in the buffer tank, it should be understood that a mixture of solid and liquid carbon dioxide could also be used.

The three main steps for unloading rail car 10 according to the present invention are illustrated in FIGS. 1–3 and include liquid unloading, vapor unloading, and buffer tank recharging. In addition to the transport vehicle 10, the storage tank 12, and the buffer tank 14, the system also includes first and second three-way valves 20, 24, first and second compressors 30, 36, and a refrigeration system 40 for cooling fluid in the storage tank 12.

When the rail car 10 arrives at a location for unloading, the rail car is connected to the unloading system at a vapor inlet 16 and a liquid outlet 18. A vapor inlet pipe 22 connects the vapor inlet 16 to a top of storage tank 12 through the three-way valve 20. A liquid outlet pipe 26 connects the liquid outlet 18 of the rail car to the storage tank 12 through a second three-way valve 24. In order to transport the liquid carbon dioxide from the rail car 10 into the storage tank 12, the three-way valve 20 is adjusted to deliver carbon dioxide gas from the storage tank to the top of the transport vehicle by the first compressor 30. The pressure applied to the liquid carbon dioxide by the vapor which has been compressed into rail car 10 by the compressor 30 causes the liquid carbon dioxide to be discharged from the rail car 10 through the liquid outlet pipe 26 and into the bottom of the storage tank 12.

Since the rail car 10 is generally at a higher pressure that the storage tank 12, opening the valve 24 in the liquid outlet pipe 26 allows liquid from the rail car 10 to be blown into the storage tank until the storage tank and rail car pressures equalize. The compressor 30 is then used to pressurize the rail car 10 to remove the remaining liquid carbon dioxide from the rail car.

However, if the rail car 10 is to be unloaded directly into delivery tankers the pressure in the rail car 10 must be reduced to an acceptable pressure of approximately 300 psig (20.68 bars) before unloading into the tanker. This pressure equalization step is performed by delivering vapor from the top of the rail car 10 through the vapor line 16 and a bypass line 44 via a bypass valve 46 to the bottom of the storage tank 12. The vapor carbon dioxide from the rail car 10 bubbles up through the liquid carbon dioxide in the storage tank causing the vapor to condense. After about 3–4 tons (2,720–3,630 kg) of vapor removal through the bypass line 44, the rail car 10 reaches a pressure of approximately 300 psig (20.68 bars). At that point the liquid carbon dioxide can be delivered directly to the delivery tankers without venting losses.

After all or substantially all of the liquid carbon dioxide has been removed from the rail car 10 into the storage tank and/or delivery tankers, the rail car remains pressurized with carbon dioxide vapor. The unloaded rail car 10 may have as much as about 3–4 tons (2,720–3,630 kg) of residual vapor carbon dioxide remaining in the car after the liquid has been unloaded. This carbon dioxide vapor is unloaded from the rail car by opening the three-way valve 20 to allow the vapor to pass from the rail car 10 into the buffer tank 14 through a buffer tank inlet line 32, as shown in FIG. 2. Because the buffer tank 14 contains carbon dioxide which has been solidified (indicated in FIGS. 1, 2, and 3 by cross hatching) and converted to "dry ice" at 60.4 psig, −69.9° F. (4.16 bars, −56.6° C.) while the rail car is at a much higher pressure of between 150 psig, −34° F. (10.34 bars, −36.7° C.) and 350 psig, 11° F. (24.13 bars, −11.7° C.), a pressure gradient between the high pressure rail car 10 and the low pressure buffer tank 14 causes the vapor to flow into the buffer tank. The vapor which enters the buffer tank 12, instantaneously condenses on the "dry ice," melting some of the "dry ice" and condensing the vapor into liquid. The process of unloading the vapor from the rail car 10 initially occurs at a rate which is limited only by the capacity of the buffer tank inlet pipe 32 and three-way valve 20 to transfer vapor into the buffer tank 14. According to one embodiment of the present invention the buffer tank inlet pipe 32 has a diameter of approximately 2 inches (5.1 cm). However, other diameters may also be used and will influence the flow rate of the vapor. The vapor flow rate achieved by the present invention is far higher than the flow rates which are possible by operating a present art compressor. Only an extremely large compressor could achieve flow rates comparable to those of the present invention.

The buffer tank inlet pipe 32 may also deliver the vapor to a location near the top of the buffer tank 14. As the "dry ice" in the buffer tank 14 begins to melt due to the inlet of the rail car carbon dioxide vapor, the resulting liquid level accumulating in the buffer tank begins to rise. The accumulating liquid carbon dioxide immerses the remaining "dry ice" beneath the liquid surface causing the vapor transfer rate to slow significantly. This slowing of the vapor condensing process occurs about half to three quarters of the way through the solid/liquid phase conversion process.

According to one preferred embodiment of the invention, the carbon dioxide vapor is introduced to the bottom of the buffer tank 14. The vapor then bubbles up through accumulating liquid carbon dioxide within the buffer tank 14 and around the submerged "dry ice" and acts as a stirring agent. The stirring action of the bubbling vapor accelerates the heat transfer between the submerged "dry ice" and the vapor. This mixing action within the buffer tank 14 caused by the carbon dioxide vapor bubbling up through the liquid allows the phase conversion to continue at a rate which is slower than the initial rate, but is much faster than the rate of conversion without any mixing.

According to an alternative embodiment of the invention, the mixing of the different phases of the carbon dioxide within the buffer tank may be enhanced by a mechanical mixing mechanism. This mixing may be performed by any one or more mechanical mixing mechanism including mechanical stirring, pumping to recirculate liquid, liquid aspiration, or the like.

The pressure within the buffer tank 14 remains substantially constant at the triple point of 60.4 psig, −69.9° F. (41.16 bars, −56.6° C.) until the "dry ice" is completely covered with liquid carbon dioxide. The pressure will then begin to increase unless the stirring action caused by adding the vapor up through the solid "dry ice" or a mechanical mixing mechanism causes adequate mixing to maintain a constant pressure and/or unless the vapor flow rate into the buffer tank decreases. The vapor flow rate from the rail car 10 to the buffer tank 14 decreases naturally as the pressures in the two chambers begin to equalize, thereby naturally reducing the flow rate as the phase change conversion slows. Accordingly the pressure in the buffer tank 14 will generally remain substantially constant until all or substantially all of the "dry ice" has been converted to liquid as long as the submerged solid is adequately contacted with the incoming vapor.

The buffer tank 14, according to the present invention, allows recovery of all but about one ton (907.2 kg) of carbon dioxide vapor from the rail car 10. However, while the rail car 10 is being unloaded, the amount of refrigeration which is required to cool the liquid carbon dioxide which is being removed from the rail car need only be sufficient to maintain the storage tank 12 at the preferred pressure. The heat load to condense the extracted vapor illustrated in the step of FIG. 2 has been absorbed by the buffer tank 14. Thus, the cooling required to maintain the preferred pressure in the storage tank 12 amounts to only about 720,000 Btu over the 4 to 8 hour unloading period compared to the $2\times10^6$ Btu required without the buffer tank 14.

Although the present invention has been described as withdrawing vapor carbon dioxide from a top of the rail car 10, the vapor may also be withdrawn from the bottom of the rail car. Withdrawing the vapor from the bottom of the rail car 10 can provide the added advantage of better vaporizing any remaining liquid left in the bottom of the rail car.

Once the rail car 10 has been unloaded of liquid and vapor carbon dioxide according to the steps illustrated in FIGS. 1 and 2, the "dry ice" in the buffer tank 14 is recharged by the process of FIG. 3. During off-peak hours when little refrigeration would otherwise be required, the second compressor 36 removes vapor from the buffer tank 14 and increases the pressure of the removed vapor high enough to enter the storage tank 12.

Although the invention has been described as employing first and second compressors 30, 36, a single compressor may also be used. The compressors 30, 36, may be either single stage or double stage compressors. Alternatively, the compressors may be replaced by pumps as long as the pumps are positioned so that cavitation is prevented.

The vapor exits the buffer tank 14 and is transported to the storage tank 12 through a buffer tank outlet pipe 38 and the three-way valve 24. As the vapor carbon dioxide is pumped into the storage tank 12 by the compressor 36, the storage tank must be cooled by the refrigeration system 40 to maintain the pressure in the storage tank below the maximum working pressure of the storage tank. The refrigeration system 40 can be as much as one third smaller than a conventional refrigeration system which would normally be sized to handle both the cooling load of the external storage tank 12 and to condense the vapor unloaded from the empty rail car 10. The refrigeration unit 40 need only be sized to provide enough cooling to maintain the storage tank pressure during the 4–8 hour unloading period. The energy required to condense the vapor carbon dioxide as it is extracted from the buffer tank 14 during recharging, may be performed over a long time period, such as 24 or 48 hours, allowing the refrigeration unit to use reserve capacity not needed after initial unloading.

As the carbon dioxide vapor is removed from the buffer tank 14 by the compressor 36, the remaining liquid carbon dioxide in the buffer tank begins to auto-refrigerate. The liquid carbon dioxide is cooled until the triple point of 60.4 psig, −69.9° F. (41.16 bars, −56.6° C.) is reached. When the triple point is reached, continued vapor removal from the buffer tank 14 converts the remaining liquid carbon dioxide to solid "dry ice." The pressure inside the buffer tank 14 remains constant until all of the liquid has been converted to "dry ice." The buffer tank 14, when filled with "dry ice," stores a large amount of energy in the form of the latent heat phase change of the "dry ice."

The cold vapor which is pumped out of the buffer tank 14 at 60.4 psig (41.16 bars) can be readily compressed to the storage tank pressures of 250 to 300 psig (17.24 to 20.68 bars) with a compressor 36, and the discharge temperatures of the vapor will still be well below the maximum allowable discharge temperatures of 250° F. to 300° F. (121° C. to 149° C.) for typical oil-free compressors. Although non-oil-free compressors may be used, oil-free compressors are preferred because they do not require separate oil filters.

The vapor compressor 36 may be controlled by a simple pressure control switch 42, shown in FIG. 3, set to shut off the vapor compressor at about 50 psig (3.45 bars). This pressure is slightly below the triple point pressure and assures that all of the liquid carbon dioxide in the buffer tank 14 has been converted to "dry ice." Once all or substantially all of the liquid carbon dioxide in the buffer tank 14 has been converted back to "dry ice", the buffer tank is ready for the unloading of a subsequent rail car. The energy storage capacity of the "dry ice" in the buffer tank 14 has an advantageously high energy storage capacity due to the 85.6 Btu/lb (47.5 Cal/g) latent heat phase change of the "dry ice."

An example of an unloading process according to the present invention for unloading a rail car containing about 84 tons (76,200 kg) of carbon dioxide at 350 psig, 11° F. (24.13 bars, −11.7° C.) involved the following steps. 3.4 tons (3,085 kg) of vapor carbon dioxide or about 4% of the carbon dioxide in the rail car was removed to lower the rail car pressure to 290 psig (20.0 bars). The liquid carbon dioxide was then removed in an amount which is approximately 90% of the original mass (76 tons). Of the about 4.6 tons (4,173 kg) of vapor carbon dioxide remaining in the rail car after removal of the liquid carbon dioxide, about 3.5 tons (3,175 kg) can be recovered into the buffer tank leaving about 1.1 tons (997 kg) or 1.3% of the total rail car carbon dioxide vapor in the rail car at 60 psig (41.13 bars).

Figure 4:
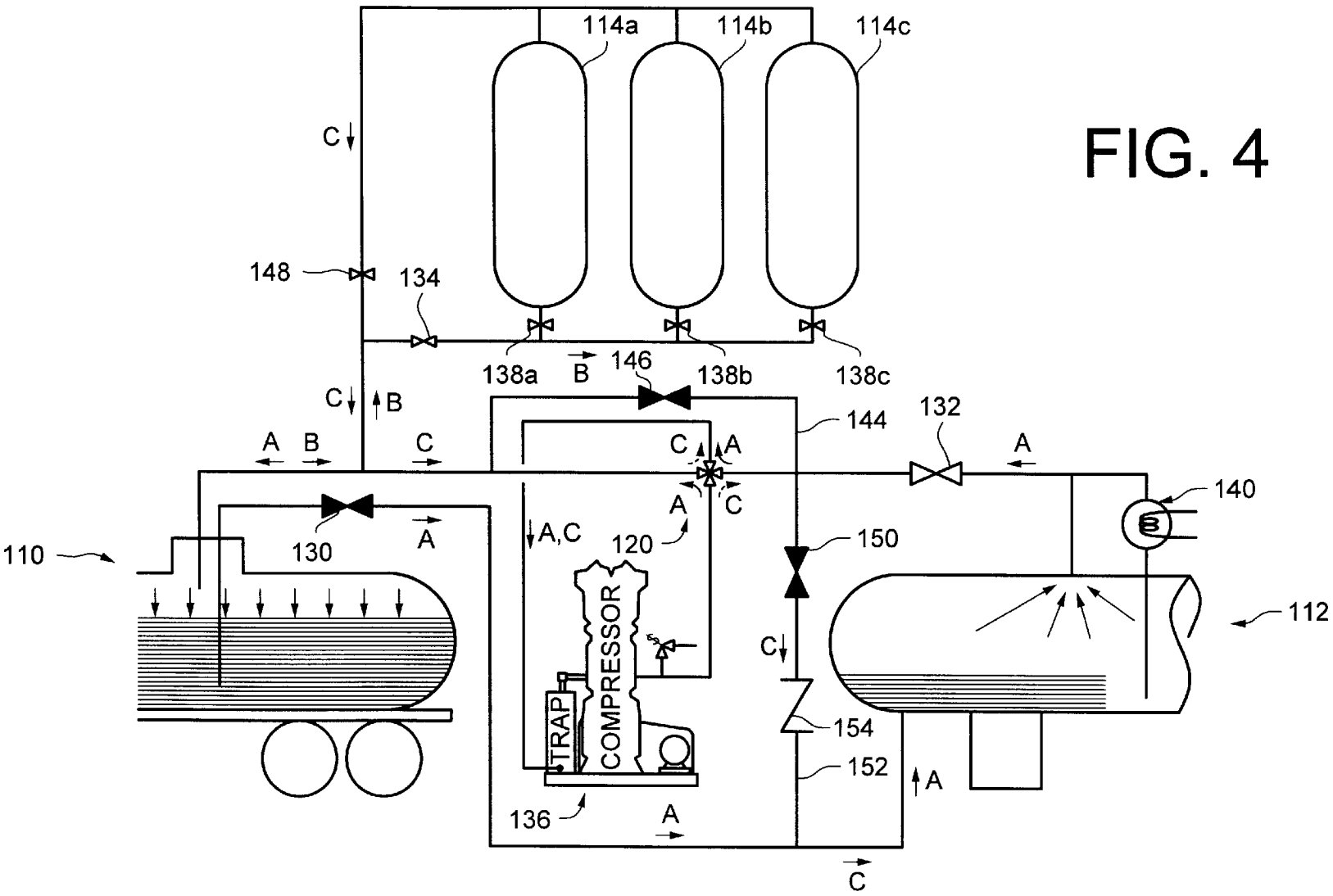
FIG. 4 is a schematic side view of a system for unloading a transport vehicle having multiple buffer tanks according to a variation of the present invention.

FIG. 4 illustrates an alternative embodiment of the invention in which multiple buffer tanks are used. The reference numerals used to designate the various components of the system of FIG. 4 correspond to the reference numerals used to designate like components in the embodiment of FIGS. 1–3 with a prefix of "1" and suffixes "a"–"c" to designate multiple parts.

The embodiment of FIG. 4 includes a transport vehicle 110, a storage tank 112 with refrigeration system 140, and a plurality of buffer tanks 114*a*, 114*b*, 114*c*. A single compressor 136 is used for both unloading the liquid carbon dioxide from the rail car 110 to the storage tank 112 and for recharging the buffer tanks 114*a*, 114*b*, 114*c*. A four-way valve 120 allows the compressor 136 to be used for both of these functions. The system also includes a plurality of control valves for directing fluid flow through the system.

The arrows A in FIG. 4 illustrate a first step of unloading the liquid carbon dioxide from the rail car 110 and delivering the liquid carbon dioxide to the storage tank 112. The liquid carbon dioxide is unloaded by opening a first valve 130, a second valve 132, and the four-way valve 120 and operating the compressor 136 to force carbon dioxide vapor into the rail car 110 and to cause liquid carbon dioxide to be removed from the rail car.

The arrows B illustrate the second step of the process in which the carbon dioxide vapor remaining in the rail car 110 after the liquid carbon dioxide has been removed is extracted from the rail car by the low pressure of the buffer tanks 114*a*, 114*b*, 114*c*. This step involves closing the valves 130, 132 and opening the valve 134 to the buffer tanks 114*a*, 114*b*, 114*c*. One or more of three buffer tank control valves 138*a*, 138*b*, 138*c* are also opened to allow carbon dioxide vapor to pass into one or more of the buffer tanks in a manner which will be described in more detail below.

Finally, the arrows C indicate the recharging of the buffer tanks 114*a*, 114*b*, 114*c* in which the vapor is caused to flow by the compressor 136 from the buffer tanks 114*a*, 114*b*, 114*c* through the four-way valve 120 to the storage tank 112. During this recharging step, the valve 134 is closed and a recharge valve 148 is opened. A recharge bypass valve 150 is also opened in a bypass line 152 to deliver the vapor to the bottom of the storage tank 112 which promotes mixing to condense vapor in the storage tank. A check valve 154 is also provided in the bypass line 152 to prevent backflow.

Similar to the embodiment of FIGS. 1–3, a bypass line 144 and bypass valve 146 are provided to bypass the compressor 136 and withdraw vapor carbon dioxide from the rail car 110 to equalize or decrease the rail car pressure to a pressure acceptable for delivery to delivery tankers. During this pressure equalization step, the bypass valves 146 and 150 are opened to deliver high pressure carbon dioxide vapor from the rail car 110 to the bottom of the lower pressure storage tank 112.

The three buffer tanks 114*a*, 114*b*, 114*c* may be used together in place of one larger buffer tank by operating the three valves 138*a*, 138*b*, 138*c* together. An alternative arrangement of three buffer tanks 114*a*, 114*b*, 114*c* involves the use of the multiple buffer tanks sequentially to remove vapor from the rail car. For example, if the buffer tank volume is marginally sized, and/or the desire is to end up with the highest possible pressure in buffer tanks 114*a*, 114*b*, 114*c*, one recovery method involves sequentially cycling the buffer tanks via the buffer tank valves 138*a*, 138*b*, 138*c*. This method requires two or more buffer tanks 114*a*, 114*b*, 114*c* each with individual tank inlet valves 138*a*, 138*b*, 138*c* preferably at or near the bottom of the tanks.

This procedure with sequential filling of the buffer tanks 114*a*, 114*b*, 114*c* results in the highest buffer tank pressure and maximum carbon dioxide vapor recovery per unit volume of the first buffer tank 114a and progressively lower pressures and recoveries on buffer tanks 114*b*, 114*c*, etc. This system achieves the fastest buffer tank recharge time due to a higher average compressor suction pressure and vapor density during the buffer recharging process. The compressor 136 is typically a fixed displacement piston type that recovers vapor faster at the higher pressure because the gas is much denser. It also allows a smaller total buffer volume while still ending up with residual "dry ice" at the 60.4 psig (41.16 bars) triple point pressure in the last buffer tank at the end of the vapor extraction process.

One example of a sequence of operation of vapor recovery with the buffer tanks in the sequential embodiment is as follows:

1) Open the vapor valve 134 from the rail car 110 and open the bottom connection valve 138*a* to the first buffer tank 114*a*. Allow the pressures to equalize. This will melt/liquefy the "dry ice" in buffer tank 114*a* at the triple point and warm the liquid to an elevated pressure/temperature. The end pressure in buffer tank 114*a* will be below the rail car 110 starting pressure, but above the carbon dioxide triple point.

2) Close the valve 138*a* to the first buffer tank 114*a*.

3) Open the valve 138*b* to the second buffer tank 114*b* and allow the second buffer tank to pressure equalize with the rail car 110.

4) Close the valve 138*b* to the second buffer tank 114*b* after equalization.

5) Open the valve 138*c* to the third buffer tank 114*c* and continue the sequence with any subsequent buffer tanks either until the rail car pressure has decreased to the triple point 60.4 psig (4.16 bars) or until all the buffer tanks are fully pressurized.

The procedure for recharging the buffer tanks 114*a*, 114*b*, 114*c* can be done in one of the two following ways. According to a first process, the compressor 120 is used to extract vapor from the individual buffer tanks 114*a*, 114*b*, 114*c* down to 60.4 psig (4.16 bars) or below sequentially. This allows for faster pumpdown with a fixed displacement compressor due to the denser high pressure carbon dioxide in buffer tank 114*a*. According to a second process, valves 138*a*, 138*b*, 138*c* are all opened and all the buffer tanks 114*a*, 114*b*, 114*c* are allowed to equalize. Then the compressor 120 is turned on to recharge the buffer tanks. This will require a slightly longer operating time because all the tanks equalize to a lower pressure.

The advantage of the sequential buffer tank arrangement is demonstrated by the following example. Buffer tank 114*a* would extract enough vapor from the rail car 110 to convert all of the "dry ice" to liquid with a latent heat change of 85.6 Btu/lb (47.5 Cal/g). The additional extracted vapor warms the liquid in the buffer tank further, increasing the liquid pressure until both the buffer tank 114*a* and the rail car equalize. This additional vapor will recover about 0.16 Btu/lb per psig rise (an approximate linearization). This means that if buffer tank 114*a* ends up at 160 psig (11.03 bars), the additional sensible heat recovered beyond the latent heat would be (160 psig−60 psig)×0.16 Btu/lb per psig=16 Btu/lb (8 Cal/g). Therefore the total energy recovery on that tank would be the sum of the latent and sensible heat recovery (85.6 Btu/lb+16 Btu/lb=101.6 Btu/lb) (56.4 Cal/g). This is an 18% increase in buffer tank capacity for this example. This additional recovery repeats to varying amounts on the remaining buffer tanks 114*b*, 114*c*, etc.

If a single buffer tank 114*a* was large enough, there would be no difference between sequential or simultaneous pressurization of the buffer tanks 114*a*, 114*b*, 114*c* since the buffer tank and rail car 110 would equalize at 60.4 psig (41.16 bars).

A simultaneous pressurization procedure using the multiple buffer tanks 114*a*, 114*b*, 114*c* is the simplest because the tanks would be manifolded together at a common pressure. This requires the least amount of valve opening and closing. With the simultaneous method, when a rail car needs the vapor extracted, the valve to the buffer tanks 134 is simply opened and the system equalizes. If the buffer tank capacity is adequate the rail car 110 and the buffer tanks 114*a*, 114*b*, 114*c* equilibrate to the triple point pressure of 60.4 psig (41.16 bars). This extracts the approximately 3 tons of residual carbon dioxide vapor without raising the storage tank 12 pressure and decreasing the rail car 110 pressure to 60 psig (41.13 bars).

While the invention has been described in detail with reference to the preferred embodiments thereof, it will be apparent to one skilled in the art that various changes and modifications can be made, and equivalents employed, without departing from the present invention.

What is claimed is:

1. A method of unloading a transport vehicle containing a liquified gas and recovering vapor remaining in the transport vehicle after the liquified gas has been removed, the method comprising:

unloading the liquified gas from the transport vehicle into a liquified gas storage tank;

unloading the vapor remaining in the transport vehicle after the liquified gas has been unloaded by delivering the vapor via a pressure gradient into a buffer tank containing solidified gas;

transferring vapor from the buffer tank to the liquified gas storage tank and thus converting liquified gas in the buffer tank to solid phase; and cooling the liquified gas and vapor in the storage tank to maintain a desired storage tank pressure.

2. The method of unloading a transport vehicle according to claim 1, wherein vapor unloaded from the transport vehicle is delivered into a bottom of the buffer tank and passes up around the solidified gas within the buffer tank improving mixing and causing the solidified gas to convert to liquified gas.

3. The method of unloading a transport vehicle according to claim 1, wherein the unloaded vapor is delivered to a top of the buffer tank.

4. The method of unloading a transport vehicle according to claim 1, wherein the transfer of vapor from the buffer tank to the liquified gas storage tank causes the liquified gas in the buffer tank to autorefrigerate and convert to the solid phase.

5. The method of unloading a transport vehicle according to claim 1, wherein vapor which is transferred from the buffer tank to the liquified gas storage tank is compressed to a liquified gas storage tank pressure of about 200 to 300 psig.

6. The method of unloading a transport vehicle according to claim 1, wherein a pressure in the transport vehicle is reduced to a pressure adequate for transfer to the liquified gas storage tank by extracting vapor from the transport vehicle into the buffer tank before unloading the liquified gas from the transport vehicle.

7. The method of unloading a transport vehicle according to claim 1, wherein the step of transferring the vapor temporarily stored in the buffer tank to the liquified gas storage tank is performed after the transport vehicle has been unloaded.

8. The method of unloading a transport vehicle according to claim 1, wherein a pressure in the transport vehicle is reduced prior to the unloading of the liquified gas by extracting vapor from the transport vehicle into the storage tank.

9. The method of unloading a transport vehicle according to claim 1, wherein the liquified gas is carbon dioxide.

10. The method of unloading a transport vehicle according to claim 1, wherein the liquified gas is nitrous oxide.

11. A system for unloading liquified gas from a transport vehicle comprising:

a storage tank for storing the liquified gas which has been unloaded from the transport vehicle;

a buffer tank for receiving and storing residual vapor remaining in the transport vehicle after the liquified gas has been unloaded, the buffer tank containing a supply of solidified gas; and means for transferring vapor from the buffer tank to the storage tank and shifting an electric demand required to condense the vapor to off peak energy rates.

12. The system for unloading a transport vehicle according to claim 11, wherein the buffer tank includes a plurality of pressure vessels positioned in a paralleled arrangement.

13. The system for unloading a transport vehicle according to claim 12, further comprising means for transferring vapor from the transport vehicle to the plurality of pressure vessels in a sequential manner.

14. The system for unloading a transport vehicle according to claim 11, wherein the means for transferring vapor from the buffer tank to the storage tank comprises a gas compressor.

15. The system for unloading a transport vehicle according to claim 14, wherein the gas compressor withdraws liquified gas from the transport vehicle to the storage tank and the means for transferring vapor further comprises a four way valve.

16. A method for shifting refrigeration electric demand, in a rail car unloading system for unloading liquified gas from the rail car, to off peak energy rates by using a buffer system which takes advantage of the latent heat conversion energy characteristics of the liquified gas, the method comprising:

unloading a vapor from the rail car into a buffer tank; and delaying the unloading of the buffer tank to a point of use until a time of off peak energy rates.

17. The method for shifting refrigeration electric demand according to claim 16, further comprising the steps of:

unloading liquified gas from the rail car;

unloading the vapor from the rail car after the liquified gas has been unloaded into the buffer tank, the buffer tank containing solidified gas; and recharging the solidified gas in the buffer tank.

* * * * *